United States Patent [19]

DeSantis et al.

[11] Patent Number: 4,966,320

[45] Date of Patent: Oct. 30, 1990

[54] SIMULATED POUCH WITH INTERIOR, CONCEALED HOLSTER

[75] Inventors: Eugene DeSantis, 149 Denton Ave., New Hyde Park, N.Y. 11040; Mitchell Bloom, New Hyde Park, N.Y.

[73] Assignee: Eugene DeSantis, New Hyde Park, N.Y.

[21] Appl. No.: 435,172

[22] Filed: Nov. 13, 1989

[51] Int. Cl.[5] ..... A45C 1/04

[52] U.S. Cl. ..... 224/229.000; 224/192; 224/196; 224/228; 224/238; 224/243; 224/901; 224/911

[58] Field of Search ..... 224/192, 196, 224, 226, 224/227, 228, 229, 238, 242, 911, 243, 901, 253, 250

[56] References Cited

U.S. PATENT DOCUMENTS

| | | | |
|---|---|---|---|
| 1,828,342 | 10/1931 | Sachs | 150/110 |
| 3,347,299 | 10/1967 | Alexander | 224/202 |
| 4,258,871 | 3/1981 | McMahon | 224/243 |
| 4,480,776 | 11/1984 | Atkins, Sr. | 224/243 |
| 4,515,300 | 5/1985 | Cohen | 224/253 |
| 4,750,655 | 6/1988 | Barry | 224/243 |

FOREIGN PATENT DOCUMENTS

| | | | |
|---|---|---|---|
| 624295 | 12/1977 | Switzerland | 224/224 |

*Primary Examiner*—Henry J. Recla
*Assistant Examiner*—Glenn T. Barrett
*Attorney, Agent, or Firm*—Nixon & Vanderhye P.C.

[57] ABSTRACT

A hand gun in a holster is completely concealed by a simulated carrying pouch. A backing is mounted on a wearer, as with a belt around the wearer's waist. A holster is mounted on the backing completely within the area defined by the top, bottom and ends of the backing. A flap, permanently attached at the bottom to the backing but releasably attached by hook and pile fasteners (VELCRO ®) at the top and two ends of the backing defines a textile material (fabric) or leather container which simulates a carrying pouch and completely conceals the holster and hand gun. Pockets may be provided in the flap. The holster is reversibly mounted on the backing using hook and pile fasteners, and hook and pile fastener straps releasably hold the hand gun within the holster. To gain access to the hand gun, the hook and pile fasteners at the top and two ends of the backing and flap are detached to completely expose the handgun for ready access.

20 Claims, 2 Drawing Sheets

FIG. 1
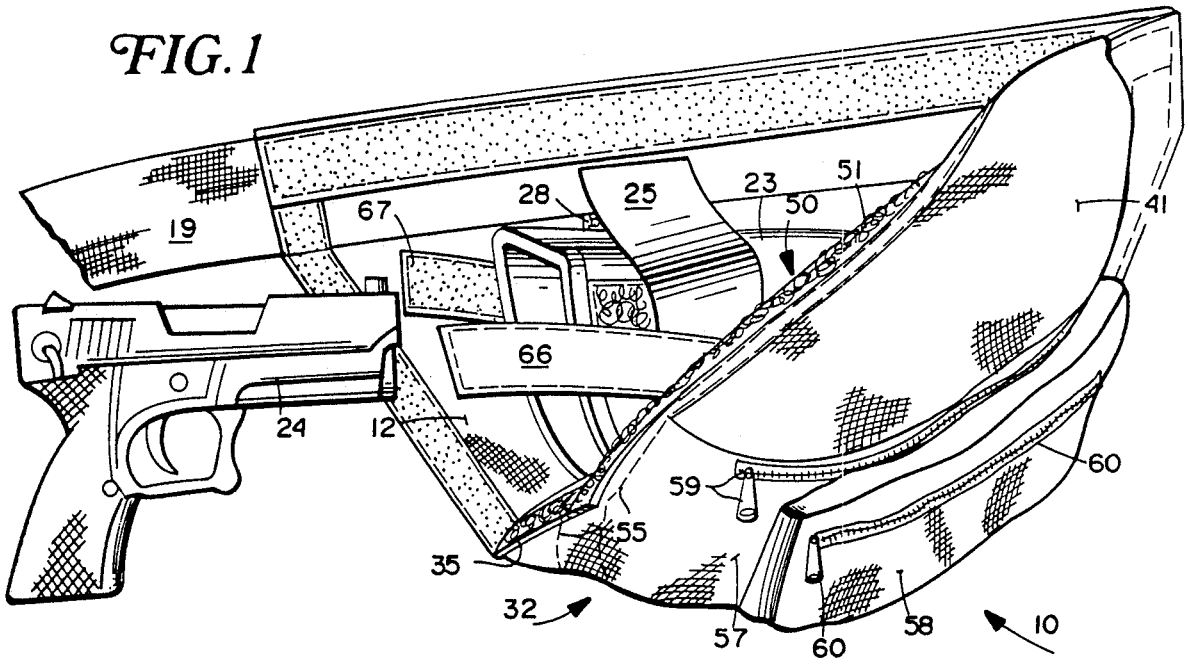
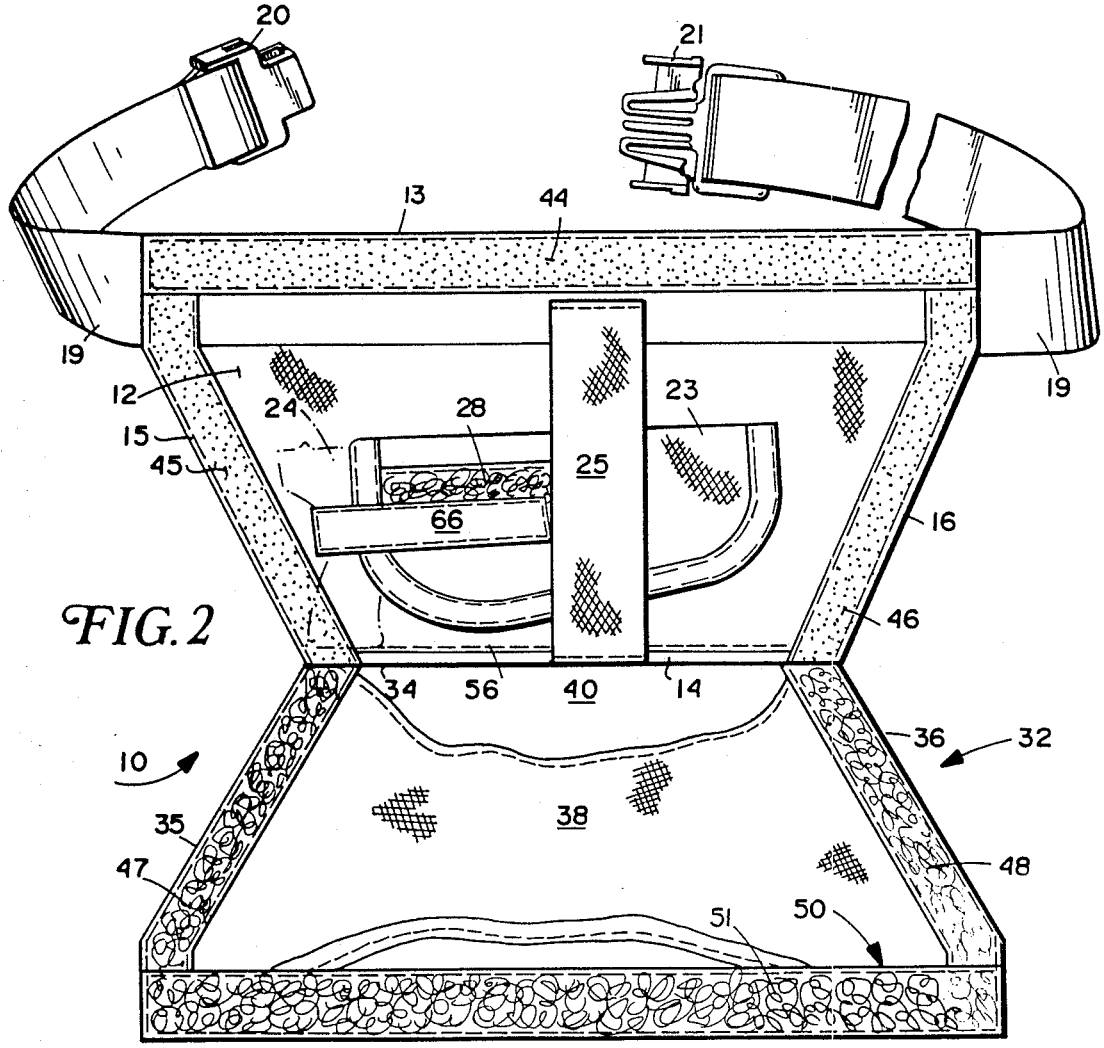
FIG. 2

SIMULATED POUCH WITH INTERIOR, CONCEALED HOLSTER

BACKGROUND AND SUMMARY OF THE INVENTION

There are many situations when a person authorized to carry a hand gun wants to completely conceal the hand gun. For example undercover policemen, couriers, plainclothes security guards, and the like oftentimes have need to completely conceal a hand gun in situations where they are not wearing a jacket, and without providing significant discomfort. However while concealment of the hand gun is desirable, the wearer must have ready access to the hand gun in emergency situations.

According to the present invention, an assembly is provided that allows a wearer to completely hide a hand gun on his/her person yet position the hand gun so that it is readily accessible for a "quick draw". This is provided according to present invention by utilizing a simulated carrying pouch assembly, which looks like a conventional carrying pouch often worn by men and women as a utilitarian article of fashion. However the simulated carrying pouch assembly has the outer portion thereof readily detachable from the inner portion to expose a holster and hand gun mounted on the interior thereof. The simulated carrying pouch assembly can be attached by a belt to the wearer's waist, or may be attached by a shoulder strap or the like.

According to one aspect of the present invention, a simulated carrying pouch assembly is provided comprising: A backing having a top, bottom, and two ends. A flap having a top, bottom, and two ends, with a central portion between the top, bottom, and two ends, with an excess of material forming the flap so that the central portion of the flap defines a container adapted to stand out from the backing. Readily releasable fastener means attaching the flap top and ends to the backing top and ends, respectively. Means for attaching the flap bottom to the backing bottom. Means for mounting the backing on a wearer. Means for mounting a holster, capable of holding a hand gun, on the backing completely within the area defined by the top, bottom, and ends thereof, and within the container defined by the flap when the flap top, bottom, and ends are in engagement with the backing top, bottom, and ends. And, a holster adapted to be mounted by the holster mounting means.

The readily releasable fastener means preferably comprise hook and pile fasteners ("VELCRO®") on the exterior of the backing ends, and interior of the flap ends. The flap bottom is preferably permanently attached to the backing bottom. The flap is preferably formed of a textile material (fabric), such as nylon, and the excess material therein is provided by fabric inserts. The flap has permanent attachment simulating means (stitching) formed at the exterior of the ends thereof, and a sub-flap at the top having part of a hook and pile fastener system formed on the exterior thereof and adapted to be bent over to engage the other part of a hook and pile fastener system at the backing top.

According to another aspect of the present invention a holster mounting system is provided for reversibly mounting a holster. The system comprises: A backing having a top and a bottom. Means for mounting the backing on a wearer. A first strip of hook and pile fastening material of one type extending from the top to the bottom at a central portion of the backing. A loop of textile material connected adjacent the backing top and bottom overlying the first strip, and having an interior surface with the one type of the hook and 10 pile fastening material. A holster having opposite sides and an open end. And, hook and pile fastening material strips of the other type disposed on the opposite sides of the holster for cooperating with the first strip and the loop for removably mounting the holster on the backing. Straps are preferably provided for releasably holding the gun in the holster at the open end thereof. One of the straps has hook and pile fasteners of one type disposed substantially along the entire length thereof, while the strap has hook and pile fasteners of one type disposed along about half the length thereof, and of the other type along the other approximately half thereof. Thus each strap cooperates with the fasteners on the holster sides, and with each other, to releasably hold the hand gun in the holster.

The holster is reversibly mounted on the backing so that it may be readily drawn by either a left handed or right handed wearer regardless of the exact positioning of the backing on the wearer's body.

According to yet another aspect of the present invention, a method is provided for concealing a hand gun yet allowing ready access thereof. The method comprises the steps of: Reversibly mounting a holster on a backing. Attaching the backing to a portion of the wearer's body. Releasably connecting a simulated carrying pouch on the backing, including at least at the top and ends thereof, so as to completely conceal the hand gun and holster. And, effecting quick release of the releasable fasteners attaching the simulated carrying pouch at the top and ends of the backing, so as to quickly expose the holster and hand gun. The step of mounting the backing on the wearer is preferably accomplished utilizing a belt attaching the backing to around the wearer's waist.

It is the primary object of the present invention to provide for the effective concealment, yet ready access to, a hand gun. This and other objects of the invention will become clear from an inspection of the detailed description of the invention, and from the appended claims.

BRIEF DESCRIPTION OF THE DRAWINGS

FIG. 1 is a top perspective exploded view showing the simulated carrying pouch assembly according to the invention when the flap is being detached to expose and allow access to the hand gun and holster, and showing the hand gun removed from the holster;

FIG. 2 is a front view of the assembly of FIG. 1 with the flap completely detached along the top and ends thereof from the backing;

DETAILED DESCRIPTION OF THE DRAWINGS

Figure 3:
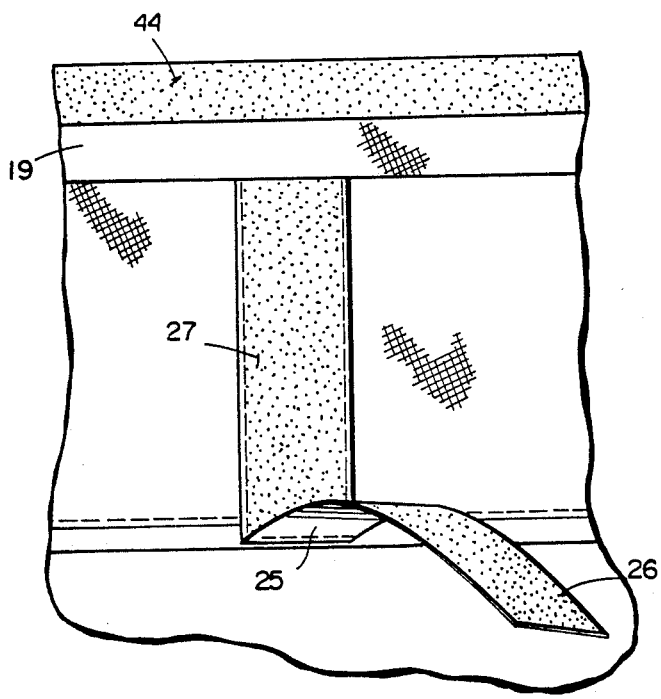
FIG. 3 is a detail exploded view showing the mechanism on the backing for releasably attaching the holster to the backing.

A simulated pouch carrying assembly according to the invention is shown generally by reference numeral 10 in FIGS. 1 and 2. One of the main components of the assembly 10 is the backing 12 which has a top 13, bottom 14, and two ends 15 and 16 (FIG. 2). The backing 12 is preferably mounted on the wearer's body at a convenient or "fashionable" position, as by utilizing a textile material belt 19 which has female 20 and male 21 fasteners at the ends thereof, the fasteners 20, 21 being conventional. While a belt 19 is shown, a shoulder strap, or other attachment device for mounting the backing 12 on the wearer, may be provided.

A holster 23 adapted to be mounted on the backing 12 is also provided, for holding a hand gun 24. The holster 23, which may be made of a textile material such as nylon, or leather, is adapted to be mounted on the backing 12 preferably in a reversible manner so that it may be readily accessed and utilized by a left handed or a right handed person. A strap of fabric material 25 is attached (as by permanent stitching) at the top and bottom thereof to the backing adjacent to the top 13 and bottom 14 of the backing 12. The interior face of the strap or loop 25, which preferably is of textile material such as nylon has one component of a hook and pile fastening system 26 formed on the interior surface thereof, and overlying a strip 27 of a preferably like component of a hook and pile fastening system 27 attached directly to the backing 12. For example both the interior surface 26 of the loop 25 and the material 27 (see FIG. 3) may be the hook component of a VELCRO® fastening system. The elements 26, 27 cooperate with pieces of material 28, 28' (see FIG. 4) associated with the holster 23, the portions 28, 28' for example being pile components of a VELCRO® fastening system.

The backing 12 may be made of a wide variety of materials. One particularly useful manner of construction, however, is to provide a flexible sheet of relatively stiff material, such as cardboard or reinforcing plastic, and cover it with fabric, and stitch, or otherwise attach, the belt 19 at the top thereof. The top of the loop 25 is then actually stitched to the belt 19. If the backing 12 is of leather, a reinforcing plastic or cardboard sheet is not necessary since backing 12 will be relatively rigid on its own.

The assembly 10 further comprises a flap 32 which has a top 33, bottom 34, and ends 35 and 36. A central portion 38 is provided between the top, bottom, and ends, 33-36, with excess material forming the flap. The excess material may be in the form of fabric inserts 40, 41 stitched to the central portion 38 and other portions of the flap 32. The flap 32 preferably is made of a textile material, such as nylon, and it may have waterproofing coating on the interior thereof. Alternatively it could be made of leather (including inserts 40, 41). A central portion 38, with fabric inserts 40, 41, defines a container adapted to stand out from the backing 12 and completely conceal the hand gun 24 in the holster 23 therewithin.

Note that the holster 23 and the holster mounting means 25, etc. mount the holster 23 and gun 24 so that they are completely within the area defined by the top, bottom, and ends 13 through 16 of the backing 12 (see FIGS. 1 and 2).

The assembly 10 further comprises readily releasable fastening means for attaching the flap top 33 and ends 35, 36 to the backing top 13 and ends 15, 16, respectively, to define a simulated pouch while allowing ready access to the gun 24 mounted on the backing 12. The readily releasable fastener means preferably comprise strips 44, 45, and 46 of one component of a hook and pile fastener system (e.g. hooks) disposed along the top 13 and ends 15, 16, respectively, of the backing 12, and strips 47, 48, and 51 of the other component of a hook and pile fastener system (e.g. pile) along the ends and tops, respectively of the flap 32. The sub-flap 50 has a strip 51 of VELCRO® pile component which engages the strip 44 hook components. The sub-flap 50 is pop stitched to the flap 32 and preferably extends the width of the top 33.

As seen in FIG. 1, permanent attachment simulating means 55 are preferably formed at the exterior of the flap 32, at least at the ends 35, 36 thereof. The permanent attachment simulating means preferably comprises stitching, as illustrated at 55 in FIG. 1. However in addition to providing permanent attachment simulation, the stitching may have a utilitarian function of actually attaching the strips 47, 48 (and even 51) of the VELCRO® to the interior end surfaces of the flap 32 (or sub-flap 50). However the VELCRO® strips can be attached by other means, such as adhesive, in which case the stitching 55 performs solely a permanent attachment simulating function to make the flap 32 appear merely as a conventional carrying pouch.

The attachment at the bottoms 14, 34 of the backing 12 and flap 32 may also be by releasable fasteners, however preferably the attachment is provided by permanent fastening means, such as the stitching 56 (FIG. 2).

It is also desirable to provide one or more pockets in the flap 32, accessible from the exterior thereof. For example a first pocket 57 (FIG. 1) and a second pocket 58 may be provided, closed by zippers 59, 60, respectively. While it is desirable that the pockets 57 and 58 be useful as real pockets, for carrying ammunition or other articles, they may merely be simulated pockets and provide only a disguising function causing the flap 32 to look as much like a conventional carrying pouch as possible. In any event, it is desirable to provide the pockets 57, 58 in such a way that they are graspable by the wearer of the assembly 10, the wearer grasping the flap 32 at the pockets 57, 58 to apply a force stripping the fastener components 44 through 46 from the fastener components 47, 48 and 51 to expose the hand gun 24 and holster 23.

Figure 4:
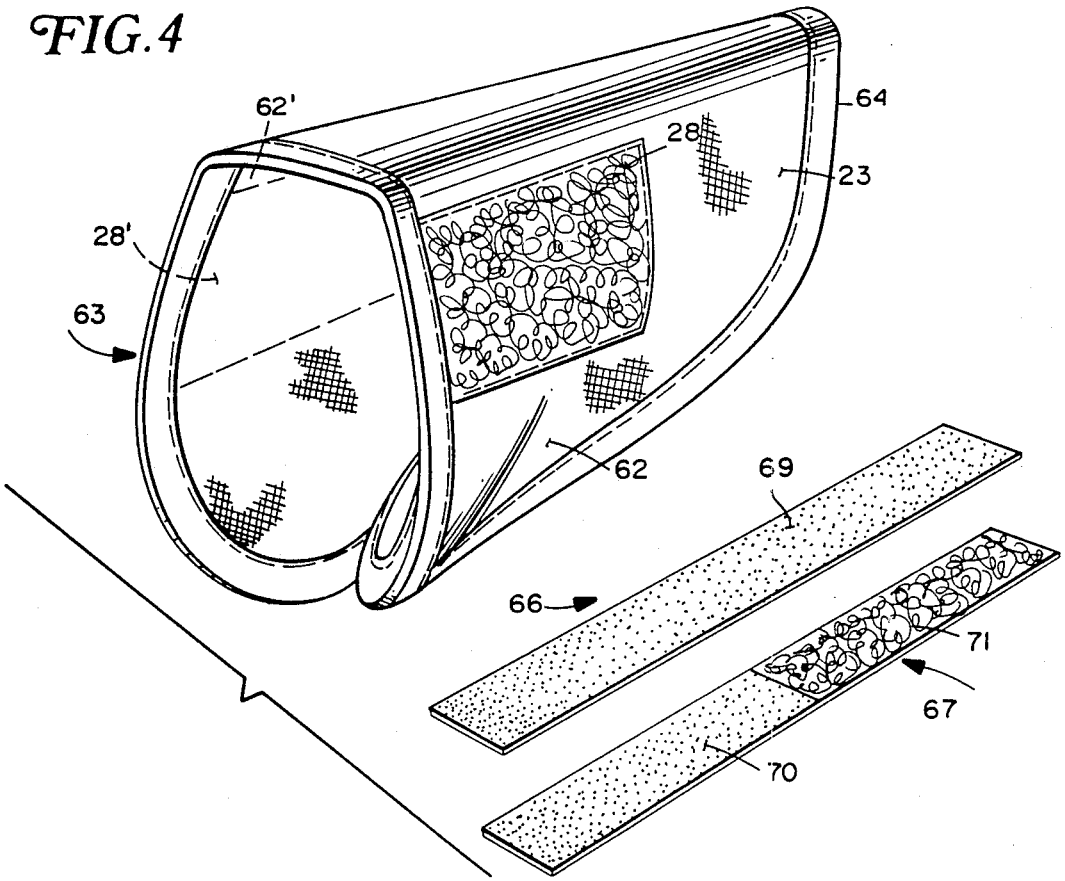
FIG. 4 is a perspective view of the holster and gun holding straps of the assembly of FIGS. 1 and 2.

The manner in which the holster 23 is mounted on the backing 12 and that the hand gun 24 is held therein is illustrated more clearly in FIG. 4. The holster 23 has opposite sides 62, 62', and an open end 63, and an end 64 opposite the open end. The end 64 may be partially open so that the muzzle of a gun may extend up to or through it, or it may be closed, depending upon the particular hand gun utilized. The holster 23 preferably is made of fabric such as nylon, with the large VELCRO® sections 28, 28' stitched or otherwise permanently attached to the sides 62, 62' respectively of the holster 23.

A pair of straps 66, 67 are provided for cooperation with the holster 23 and the gun 24 therein for releasably holding the hand gun in the holster 23. The strap 66 has on an innerface thereof a hook and pile fastener component 69 substantially along the length thereof, e.g. hooks. The strap 67, on the other hand, has one component of a hook and pile fastening system, such as hooks 70, along approximately half the length thereof, while the other fastener component, loops, 71 are provided along the approximate other half thereof. In this way the straps 66, 67 are connected at one end thereof to the VELCRO® loop sections 28, 28', and are connected at the other ends thereof (loop 71 to hook 69) to each other. The straps have a length long enough to engage both the VELCRO® sections 28, 28' and each other past the hand gun 24, as illustrated in FIG. 2.

Note that the sections 28, 28' are large enough so that they can cooperate both with straps 66, 67 and the fastener components 26, 27 (FIG. 3), to both releasably mount the holster 23 on the backing 12, and hold the gun 24 within the holster 23.

In the typical method of utilization of the assembly 10, the user inserts the hand gun 24 in the holster 23, and puts the straps 66, 67 into engagement with the VELCRO® sections 28, 29, and the loops 71 in engagement with the hooks 69 at the opposite end of the hand gun 24 from the holster 23, to releasably hold the hand gun 24 within the holster 23. Then the holster 23 is inserted between the loop 25 and backing 12, in either direction depending upon whether the wearer is left handed or right handed and where the assembly 10 will be mounted on the wearer's body, so that the loops of the sections 28, 28' engage the hooks of the sections 26, 27. The holster 23 is thus releasably mounted on the backing 12, and the holster 23 and hand gun 24 are completely within the area defined by the top, bottom, and ends 13 through 16 of the backing 12.

After the holster 23 is mounted on the backing 12, the wearer pivots the flap upwardly about the bottom portions 14, 34 of the backing 12 and flap 32, respectively, and presses the VELCRO® strips 47, 45 into contact with each other, and the strips 48, 46 into contact with each other. At the top, the VELCRO® portion 51 of sub-flap 50 is pressed into engagement with the VELCRO® strip 44. The assembly 10 so positioned completely simulates a conventional carrying pouch, which is well known as a utilitarian and fashion item. The wearer then mounts the assembly 10 on his/her body, as by putting the belt 19 around the wearer's waist and connecting the fasteners 20, 21 to each other with the flap 32 at, for example, the wearer's left side (if the wearer is right handed).

In order to gain ready access to the hand gun 24, such as if the wearer is an undercover policeman making an arrest, the wearer grasps the flap 32 at the pockets 57, 58 with his/her left hand, exerts a downward and outward force which causes the VELCRO® portions 44 through 46 to detach from the VELCRO® portions 47, 48 and 51, exposing the hand gun 24. The wearer then reaches his/her hand over the backing 12 and grasps the handle of the hand gun 24, and exerts a pulling force. This automatically separates the VELCRO® components 71, 69 holding the straps 66, 67 together, so that the gun 24 easily moves out of the holster 23.

It will thus be seen that according to the present invention a simple yet effective assembly is provided which allows for a hand gun to be completely concealed on a wearer's body, yet be readily accessible. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and procedures.

What is claimed is:

1. A simulated carrying pouch assembly, comprising:

a backing having a top, bottom, and two ends;

a flap having a top, bottom, and two ends, with a central portion between the top, bottom, and two ends, an excess of material forming the flap central portion so that the central portion of the flap defines a container adapted to stand out from the backing;

readily releasable fastener means attaching said flap top and ends to said backing top and ends, respectively so that upon detachment of said flap top and ends from said backing said flap drapes downwardly and said backing is readily accessible;

means for attaching said flap bottom to said backing bottom;

means for mounting said backing on a wearer;

means for mounting a holster, capable of holding a hand gun, on said backing completely within the area defined by said top, bottom, and ends thereof, and within the container defined by said flap when said flap top, bottom, and ends are in engagement with said backing top, bottom, and ends; and a holster adapted to be mounted by said holster mounting means.

2. An assembly as recited in claim 1 wherein said backing has an interior and an exterior and said flap has an exterior and an interior, and wherein said readily releasable fastener means comprise cooperating hook and pile fasteners on the exterior of said backing ends, and interior of said flap ends.

3. An assembly as recited in claim 1 wherein said flap has at least one graspable exterior pocket formed therein.

4. A system as recited in claim 1 wherein said holster has opposite sides and an open end, and further comprising strips of hook and pile fastener material disposed on the opposite sides of said holster, and straps for holding a gun in said holster at the open end thereof, one of said straps having hook and pile fasteners of one type disposed substantially along the entire length thereof, while the other strap has hook and pile fasteners of one type disposed along about half of the length thereof, and of the other type along the other approximately half thereof.

5. A system as recited in claim 1 wherein said flap is of textile material.

6. A system as recited in claim 5 wherein said means for mounting said backing on a wearer comprises a belt.

7. A system as recited in claim 5 wherein said flap includes upper and lower inserts of textile material providing said excess of material defining a container, and wherein said flap has at least one graspable exterior pocket formed therein.

8. An assembly as recited in claim 1 wherein said flap and said backing are of leather.

9. An assembly as recited in claim 1 wherein said means for attaching said flap bottom to said backing bottom comprises permanent attaching means.

10. A holster mounting system for reversibly mounting a holster, comprising:

a backing having a top and a bottom;

means for mounting said backing on a wearer;

a first strip of hook and pile fastening material of one type extending from said top to said bottom at a central portion of said backing;

a flexible loop of material connected adjacent said backing top and bottom overlying said first strip, and having an interior surface with said one type of said hook and pile fastening material;

a holster having opposite sides and an open end; and hook and pile fastening material strips of the other type of hook and pile fastening material besides said first type, disposed on said opposite sides of said holster for cooperating with said first strip and said loop for removably mounting said holster on said backing.

11. A holster mounting system as recited in claim 10 further comprising straps for holding a hand gun in said holster at the open end thereof, one of said straps having hook and pile fasteners of one type disposed substantially along the length thereof, while the other strap has hook and pile fasteners of one type disposed along about half of the length thereof, and of the other type along the other approximately half thereof, said straps each being long enough to engage the hook and pile fastener material on one side of said holster while the other end extends past a portion of the hand gun, which it holds in place.

12. A holster system as recited in claim 11 wherein said holster is made of textile material.

13. A holster assembly as recited in claim 11 wherein said strips of hook and pile fastening material on said holster opposite sides have a substantially greater width than the width of said straps, so that said strips on said holster engage both said first strip and loop hook and pile fastening material, and said straps, and are releasably held to both.

14. A method of concealing, yet having ready access to, a hand gun, comprising the steps of:

reversibly mounting a holster on a backing;

attaching the backing to a portion of the wearer's body;

releasably connecting a simulated carrying pouch, having top and ends on said backing, including at least at the top and ends thereof, so as to completely conceal the hand gun and holster; and effecting quick release of the releasable fasteners attaching the simulated carrying pouch at the top and ends of the backing, so as to quickly expose the holster and hand gun.

15. A method as recited in claim 14 wherein said step of mounting said backing on the wearer's body is practiced by mounting the backing at the wearer's waist utilizing a belt.

16. A simulated carrying pouch assembly, comprising:

a backing having a top, bottom, and two ends;

a flap having a top, bottom, and two ends, with a central portion between the top, bottom, and two ends, an excess of material forming the flap central portion so that the central portion of the flap defines a container adapted to stand out from the backing;

readily releasable fastener means attaching said flap top and ends to said backing top and ends, respectively;

means for attaching said flap bottom to said backing bottom, comprising permanent attaching means;

means for mounting said backing on a wearer;

means for mounting a holster, capable of holding a hand gun, on said backing completely within the area defined by said top, bottom, and ends thereof, and within the container defined by said flap when said flap top, bottom, and ends are in engagement with said backing top, bottom, and ends; and a holster adapted to be mounted by said holster mounting means.

17. A simulated carrying pouch assembly, comprising: a backing having a top, bottom, and two ends;

a flap having a top, bottom, and two ends, with an exterior and interior of each, and with a central portion between the top, bottom, and two ends, an excess of material forming the flap central portion so that the central portion of the flap defines a container adapted to stand out from the backing;

readily releasable fastener means attaching said flap top and ends to said backing top and ends, respectively;

means for attaching said flap bottom to said backing bottom;

means for mounting said backing on a wearer;

means for mounting a holster, capable of holding a hand gun, on said backing completely within the area defined by said top, bottom, and ends thereof, and within the container defined by said flap when said flap top, bottom, and ends are in engagement with said backing top, bottom, and ends;

a holster adapted to be mounted by said holster mounting means; and said flap having permanent attachment simulating means formed at the exterior of said ends thereof, and a sub flap at the top thereof having part of a hook and pile fastener system formed thereon.

18. A system as recited in claim 17 wherein said permanent attachment simulating means comprises stitching, and wherein said stitching also comprises means for attaching strips of a hook and pile fastening system to said flap ends, for cooperating with another part of said hook and pile fastening system at said backing ends.

19. A system as recited in claim 17 wherein said holster has opposite sides and an open front, and further comprising releasable fastening means formed on said opposite sides; and wherein said holster mounting means comprises releasable fastening means for cooperating with said holster releasable fastening means.

20. A system as recited in claim 19 wherein said holster and holster mounting means releasable fastening means comprise strips of a hook and pile fastening system; and wherein said holster mounting means further comprise a first strip of hook and pile system fasteners mounted at a central portion of the exterior of said backing and extending substantially from the top to the bottom thereof, and a loop of textile material fastened at the top and bottom to the top and bottom of said backing, overlying said first strip, and having an interior, second strip of hook and pile system fasteners.

* * * * *

US004966320B1

REEXAMINATION CERTIFICATE (3843rd)

United States Patent [19] [11] B1 4,966,320

DeSantis et al. [45] Certificate Issued Aug. 24, 1999

[54] SIMULATED POUCH WITH INTERIOR, CONCEALED HOLSTER

[75] Inventors: Eugene DeSantis, 149 Denton Ave., New Hyde Park, N.Y. 11040; Mitchell Bloom, New Hyde Park, N.Y.

[73] Assignee: Eugene DeSantis, New Hyde Park, N.Y.

Reexamination Request:
No. 90/004,795, Oct. 8, 1997

Reexamination Certificate for:

| | |
|---|---|
| Patent No.: | **4,966,320** |
| Issued: | **Oct. 30, 1990** |
| Appl. No.: | **07/435,172** |
| Filed: | **Nov. 13, 1989** |

[51] Int. Cl.[6] ..... A45C 1/04

[52] U.S. Cl. ..... 224/665; 224/192; 224/196; 224/238; 224/243; 224/587; 224/664; 224/683; 224/901.4; 224/901.6; 224/901.8; 224/911; 224/931

[58] Field of Search ..... 224/153, 191, 224/192, 660, 663, 665, 676, 677, 235, 236, 242, 243, 245, 911, 901, 901.2, 901.4, 901.8

[56] References Cited

U.S. PATENT DOCUMENTS

| | | | |
|---|---|---|---|
| D. 238,725 | 2/1976 | Zerobnick . | |
| 1,828,342 | 10/1931 | Sachs | 150/110 |
| 3,347,299 | 10/1967 | Alexander | 224/202 |
| 4,022,361 | 5/1977 | Devlin | 224/192 |
| 4,029,243 | 6/1977 | Zerobnick . | |
| 4,180,114 | 12/1979 | Katz | 224/153 |
| 4,258,871 | 3/1981 | McMahon | 224/243 |
| 4,262,832 | 4/1981 | Perkins . | |
| 4,480,776 | 11/1984 | Atkins, Sr. | 224/911 |
| 4,515,300 | 5/1985 | Cohen | 224/253 |
| 4,545,414 | 10/1985 | Baum . | |
| 4,724,791 | 2/1988 | McSorley . | |
| 4,750,655 | 6/1988 | Barry | 224/243 |

FOREIGN PATENT DOCUMENTS

| | | | |
|---|---|---|---|
| 624295 | 12/1977 | Switzerland | 224/224 |

OTHER PUBLICATIONS

*Women & Guns,* Jul., 1989, "Practical Accessories: for the Woman Who Runs Alone", p. 5.
1987 DeSantis Holster & Leather Goods catalog.
*Guns & Ammo,* Jul. 1983, p. 74.
*Street Survival Handbook,* 1984, vol. 1, No. 2, "Lethal Lady's Leather" by Mark Moritz, pp. 18–19, 5.
*The Robb Report,* Jul. 1988, "Holster Carrying Cases" by Guardian Leather.
*Firepower,* Sep. 1984, "Purses From The Mrs. James Bond Collection", p. 68, 69, 75.
Tactical Enterprises, Inc. brochure (price sheet dated 1988).
1985 J.B. Battle Catalog, p. 5 and Price List.
*Firepower,* May, 1986, p. 10.
*Guns & Ammo,* Feb. 1987, Women & Shooting, by Jo Anne Hall, p. 58.
*American Survival Guide,* Mar. 1987, New Products, p. 14.

*Primary Examiner*—Allan W. Shoap

[57] ABSTRACT

A hand gun in a holster is completely concealed by a simulated carrying pouch. A backing is mounted on a wearer, as with a belt around the wearer's waist. A holster is mounted on the backing completely within the area defined by the top, bottom and ends of the backing. A flap, permanently attached at the bottom to the backing but releasably attached by hook and pile fasteners (VELCRO ®) at the top and two ends of the backing defines a textile material (fabric) or leather container which simulates a carrying pouch and completely conceals the holster and hand gun. Pockets may be provided in the flap. The holster is reversibly mounted on the backing using hook and pile fasteners, and hook and pile fastener straps releasably hold the hand gun within the holster. To gain access to the hand gun, the hook and pile fasteners at the top and two ends of the backing and flap are detached to completely expose the handgun for ready access.

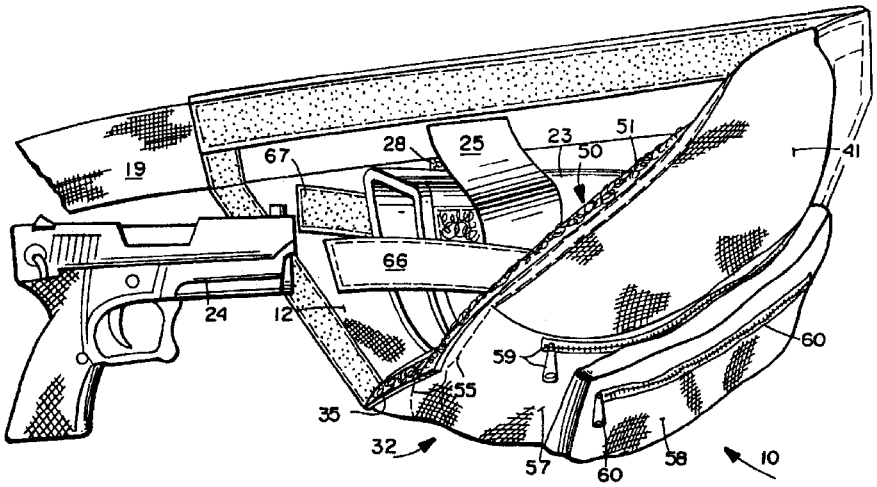

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–20 is confirmed.

New claims 21–32 are added and determined to be patentable.

*21. An assembly as recited in claim 1 wherein said simulated carrying pouch assembly accurately simulates a conventional waist pouch worn by men and women as a utilitarian article of fashion, and includes a waist strap as said means for mounting said backing on a wearer.*

*22. An assembly as recited in claim 21 wherein said readily releasable fastener means comprises components which allow quick draw of a gun mounted by said holster by grasping a structure exterior of said backing.*

*23. An assembly as recited in claim 1 wherein said readily releasable fastener means comprises components which allow quick draw of a gun mounted by said holster by grasping a structure exterior of said backing.*

*24. An assembly as recited in claim 16 wherein said simulated carrying pouch assembly accurately simulates a conventional waist pouch worn by men and women as a utilitarian article of fashion, and includes a waist strap as said means for mounting said backing on a wearer.*

*25. An assembly as recited in claim 24 wherein said readily releasable fastener means comprises components which allow quick draw of a gun mounted by said holster by grasping a structure exterior of said backing.*

*26. An assembly as recited in claim 16 wherein said readily releasable fastener means comprises components which allow quick draw of a gun mounted by said holster by grasping a structure exterior of said backing.*

*27. An assembly as recited in claim 17 wherein said simulated carrying pouch assembly accurately simulates a conventional waist pouch worn by men and women as a utilitarian article of fashion, and includes a waist strap as said means for mounting said backing on a wearer.*

*28. An assembly as recited in claim 27 wherein said readily releasable fastener means comprises components which allow quick draw of a gun mounted by said holster by grasping a structure exterior of said backing.*

*29. An assembly as recited in claim 17 wherein said readily releasable fastener means comprises components which allow quick draw of a gun mounted by said holster by grasping a structure exterior of said backing.*

*30. An assembly as recited in claim 21 further comprising a handgun disposed in said holster.*

*31. An assembly as recited in claim 24 further comprising a handgun disposed in said holster.*

*32. An assembly as recited in claim 27 further comprising a handgun disposed in said holster.*

* * * * *